US008215873B1

(12) United States Patent
Lugo et al.

(10) Patent No.: US 8,215,873 B1
(45) Date of Patent: Jul. 10, 2012

(54) AUGER ANCHOR PILE ASSEMBLY AND METHOD OF CONNECTING ANCHOR PILES

(75) Inventors: Mario R. Lugo, Houston, TX (US); Randolph G. Smith, Houston, TX (US); Noel F. Mascarenhas, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 0 days.

(21) Appl. No.: 13/359,820

(22) Filed: Jan. 27, 2012

Related U.S. Application Data

(62) Division of application No. 12/789,710, filed on May 28, 2010.

(51) Int. Cl.
*E02D 5/08* (2006.01)
*F16L 27/06* (2006.01)

(52) U.S. Cl. ..... 405/251; 285/276

(58) Field of Classification Search ..... 405/231, 405/232, 249, 250, 251; 285/321, 276, 305; 175/22, 257
See application file for complete search history.

(56) References Cited

U.S. PATENT DOCUMENTS

| | | | | |
|---|---|---|---|---|
| 3,718,350 | A * | 2/1973 | Klein | 285/39 |
| 4,637,757 | A | 1/1987 | Aagaard | |
| 4,637,758 | A * | 1/1987 | Tamaki et al. | 405/248 |
| 5,295,767 | A * | 3/1994 | Taki | 405/233 |
| 5,704,732 | A | 1/1998 | Horton | |
| 6,129,487 | A | 10/2000 | Bermingham et al. | |
| 6,719,496 | B1 | 4/2004 | Von Eberstein | |
| 7,140,319 | B2 | 11/2006 | Raines | |
| 2004/0173383 | A1 * | 9/2004 | Hollingsworth et al. | 175/323 |
| 2005/0074298 | A1 * | 4/2005 | Jones | 405/252.1 |
| 2009/0108580 | A1 * | 4/2009 | Hoffman | 285/277 |

FOREIGN PATENT DOCUMENTS

JP 02164915 A * 6/1990

* cited by examiner

*Primary Examiner* — John Kreck
*Assistant Examiner* — Kyle Armstrong
(74) *Attorney, Agent, or Firm* — Egbert Law Offices PLLC

(57) ABSTRACT

An anchor pile apparatus for placement in subsea soil has a tubular member has an interior passageway, a support structure affixed to the upper end of the tubular member, a shaft rotatably mounted in the support structure and extending downwardly through the interior passageway of the tubular member, and an auger connected to the shaft. A suitable hydraulic torquing tool can be connected to the shaft so as to cause the shaft to rotate for the purpose of rotating the auger. The auger is rotated so as to draw the tubular member into the subsea soil. The tubular member has a plurality of fins extending radially outwardly therefrom.

11 Claims, 6 Drawing Sheets

AUGER ANCHOR PILE ASSEMBLY AND METHOD OF CONNECTING ANCHOR PILES

CROSS-REFERENCE TO RELATED APPLICATIONS

The present invention claims divisional priority from application Ser. No. 12/789,710, filed on May 28, 2010, entitled "AUGER ANCHOR PILE ASSEMBLY AND METHOD OF CONNECTING ANCHOR PILES", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to anchor piles that are used for subsea installations. More particularly, the present invention the relates to anchor piles that include mechanisms for achieving the installation of the anchor pile. More specifically, the present invention the relates to anchor piles that have a rotatable auger for the purpose of drawing the anchor pile into the subsea soil. Additionally, the present invention relates to anchor pile assemblies and methods of connecting the anchor piles together.

2. Description of Related Art Including Information Disclosed Under 37 CFR 1.97 and 37 CFR 1.98

Offshore structures, vessels and floating rigs require anchoring points to safely moor or position them in situ, or to offer resistance to allow rig repositioning or movement. Known anchoring systems use fluke, gravity, suction-type anchors, or driven foundation piles to provide resistance to lateral or tension loads. Fluke, gravity and suction anchors provide limited and unquantified pull-out resistance, and have been installed in a variety of ways, e.g. by dragging flukes into the seabed, or by suctioning structures into the seabed.

Shallow water systems may make use of piles driven and/or drilled into the ocean floor to provide resistance to compression, tension or lateral loads. However, in deep sea and ultra-deep environments, increased installation costs limit the use of subsea pile driving hammers for pile foundation. As is well known in the art, a pile driver system operates through the repeated striking of a foundation element with loads or forces of high magnitude. This advances the foundation elements into the ground in increments. The kinetic energy output of a pile driver is a function of its ram mass and the velocity of the ram at impact. Pile driving is accomplished through the transmission of the kinetic energy of the pile driver to the pile to overcome resistance and loss forces and impart a displacement to the pile. The hammering systems are efficient only up to a certain length of pile. Once a critical depth has been reached, the subsea hammering process becomes inefficient. Additionally, the subsea hammers require expensive support surface equipment before operation.

In the past, various patents have issued relating to such subsea anchor piles and methods of installation. For example, U.S. Pat. No. 4,637,757, issued on Jan. 20, 1987 to K. M. Aagaard, teaches a barbed anchor pile. This anchor pile has horizontally placed barbs so as to allow the barbs to be driven into the seafloor. Once the pile is buried to a predetermined depth, the barbs are spread outwardly into the surrounding soil to ensure that the pile will not be pulled out by uplift loads.

U.S. Pat. No. 6,129,487, issued on Oct. 10, 2000 to Bermingham et al., shows an underwater pile driving tool for the purposes of installing anchor piles in a ground formation that is submerged under a body of water. A hammer body is fixedly supported in axial alignment with the head of a pile that is to be driven and carries a reaction body guided for movement thereon in a direction that is axial to the pile. The hammer body and reaction body define opposed first and second ends of an expansion chamber. A pyrotechnic charge is initiated to create a rapidly expanding volume of high pressure gas in the expansion chamber to generate a downwards pressure force pulse to drive the pile. This causes equal and opposite upwards pressure force pulse to be applied to the reaction body.

U.S. Pat. No. 6,719,496, issued on Apr. 13, 2004 to W. H. Von Eberstein, shows an ROV-installed suction pile. This suction pile has flood valves opened on the top thereof so as to allow the suction pile to be off-loaded from the anchor boat and lowered to the sea floor. The suction pile anchor is set down and the rate of feed is adjusted to match the rate of self-penetration. An ROV with pump capability closes the flood valves on the top of the suction pile and attaches to the pumping port of the suction pile. The pump of the ROV operates to draw down the suction pile to a full depth and brings the first load line connection and the attached first end of the load line well below the mudline while the second load connection at the second end of the load line is supported above the mudline. The ROV disconnects from the pump port and connects a mooring line to the second load connection.

U.S. Pat. No. 7,140,319, issued on Nov. 24, 2006 to R. V. Raines, shows a pile anchor having external vanes. This pile anchor is an elongated hollow member. The external vanes are longitudinally disposed thereon. The external vane helps to maintain the heading and bearing of the anchor during the installation process and also to enhance the pile anchor's holding capacity.

U.S. Pat. No. 5,704,732, issued on Jan. 6, 1998 to E. E. Horton, provides a deep water piling and method of installing or removing. This device is intended to eliminate the need for underwater hammers or pile drivers. The pile is a hollow tube that is open at the lower end and provided with a fitting at the upper end for attachment to a lowering pipe. The fitting at the upper end also allows for fluid communication between the lowering pipe and the pile. Air is injected into the lowering pipe draws water from the lowering pipe and pile. This creates a hydrostatic pressure differential whereby the greater pressure on the outside of the pile head forces the pile into the sea floor. Removal of the pile may be accomplished by injecting high pressure water into the pile through the pile head. The high pressure water injection aids in overcoming the hydrostatic pressure on the outside of the pile head.

It is an object of the present invention to install anchor piles in subsea soils.

It is another object of the present invention to provide for the installation of longer piles in deeper water.

It is another object of the present invention to provide a stronger anchor than can be installed in association with subsea hammers.

It is sill a further object of the present invention to provide an anchor pile that is smaller and stronger than conventional piles in ultra-deep water.

It is still a further object of the present invention to provide an anchor pile that can be effectively installed by an ROV and with minimal surface installations and equipment.

It is another object of the present invention to provide an anchor pile that allows for installation from a small, inexpensive vessel.

It is another object of the present invention to allow for installation of a long pile by stacking several shorter piles one over the previous installed pile and repeating this procedure until the desired pile length is reached, all from a low-cost installation vessel.

It is another object of the present invention to provide an anchor pile assembly whereby desired lengths of anchor piles can be connected in end-to-end relationship in a subsea location.

It is a further object of the present invention to provide a method of connecting anchor piles in end-to-end relationship in a convenient and simple manner.

These and other objects and advantages of the present invention will become apparent from a reading of the attached specification and appended claims.

BRIEF SUMMARY OF THE INVENTION

The present invention is an anchor pile apparatus for placement in a subsea soil. This anchor pile apparatus comprises a tubular member having an interior passageway and an auger rotatably mounted within or aligned with the interior passageway of the tubular member. The auger is rotatable so as to draw the tubular member into the subsea soil. A support structure is mounted at the upper end of the tubular member. A shaft extends from the support structure and is connected to the auger.

In the present invention, the support structure has bearings positioned therein. The shaft is rotatably mounted within the bearings. A suitable driving means is connectable to the shaft for imparting torque to the shaft from a location external of the tubular member. This "driving means" can include a variety of different techniques such as ROV-driven torquing tools, surface-mounted rotational devices, hydraulic manipulators, and similar devices.

The tubular member has a thrust bearing positioned within the interior passageway. The auger is rotatably positioned within the thrust bearing. The tubular member also has a plurality of fins extending radially outwardly therefrom. In the preferred embodiment, this plurality of fins are positioned at the bottom end of the tubular member. The plurality of fins can be a first set of fins that extend radially outwardly of the tubular member, and a second set of fins extending radially outwardly of the tubular member in spaced relation to the first set of fins.

The shaft is a pipe having an interior passageway. The support structure has an inlet port formed therein. This inlet port communicates with the interior passageway of the pipe. The auger has a nozzle formed thereon. The interior passageway of the pipe is in fluid communication with the nozzle so as to direct a lubricating fluid toward the bottom end of the tubular member.

The support structure has at least one vent formed therein. This vent is suitable for expelling water therethrough as the tubular member is drawn into the subsea soil.

The present invention is also a method of installing an anchor pile into a subsea soil. This method includes the steps of: (1) lowering the anchor pile to a subsea location such that the auger to contactS the subsea soil; and (2) rotating the auger so as to draw the tubular member into the subsea soil to a desired depth. In this method, a lubricant fluid is passed outwardly of the auger and toward a lower end of the tubular member during the step of rotating. Water is vented outwardly of the anchor pile as the tubular member is drawn into the subsea soil. The lubricant fluid can flow through the support structure and through an interior of the shaft. The maximum length of the pile is determined by the size/length of the boat. By stacking another section of pile over the one previously installed, the length of the pile can be adjusted to the desired length. The vents can be plugged after installation so as to give the anchor pile added strength.

The present invention is also an anchor pile apparatus that comprises a first tubular member, a support structure affixed to an upper end of the first tubular member so as to define a generally tubular passageway, a first shaft rotatably mounted in the support structure so as to extend through the interior passageway of the first tubular member, a second shaft having a pin member at a lower end thereof so as to be received in the generally tubular passageway such that the first shaft is connected in end-to-end relationship with the second shaft, and a second tubular member having a interior passageway through which the second shaft extends. The first shaft has an end connector formed at an upper end thereof. The second tubular member has a lower end abutting an upper end of the first tubular member.

In this anchor pile apparatus, a latch is affixed to the pin member of the second shaft so as to engage a wall of the generally tubular passageway of the support structure. Specifically, the pin member has a notch extending circumferentially therearound. The wall of the generally tubular passageway has a groove formed therein. This latch includes an annular member that is received in the notch of the pin member and in the groove of the wall of the generally tubular passageway.

The end connector has a first cylindrical portion and a second cylindrical portion extending upwardly from a first cylindrical portion. The pin member has a receptacle receiving the first and second cylindrical portions therein. The first cylindrical portion has a seal extending therearound. This seal is in liquid-tight sealing relationship with an inner wall of the receptacle.

The first shaft is in the nature of a first pipe having an interior passageway. The second shaft is in the nature of a second pipe having an interior passageway that is in fluid communication with the interior passageway of the first pipe. The second tubular member has a skirt extending downwardly from the lower end thereof. The skirt extends around an exterior surface of the upper end of the first tubular member. The support structure has a funnel formed at an upper end thereof. This funnel opens to the generally tubular passageway of the support structure. The second tubular member has a plurality of fins extending radially outwardly therefrom. An auger is connected to an end of the shaft opposite the support structure. The auger can be positioned between the upper end and the lower end of the first tubular member or it can be positioned outwardly of the lower end of the first tubular member.

The present invention is also a method of connecting a first anchor pile to a second anchor pile in an undersea location. This method comprises the steps of: (1) inserting the first anchor pile into the subsea soil at the subsea location such that an upper end of the first anchor pile extends outwardly of the subsea soil; (2) lowering the second anchor pile toward the first anchor pile such that an a lower end of the second anchor pile faces the support structure of the first anchor pile; (3) inserting a pin member of the second anchor pile into the generally tubular passageway of the support structure; and (4) latching the pin member against the wall of the generally tubular passageway of the support structure.

In this method, the upper end of the first anchor pile is inserted into the skirt that extends downwardly from the lower end of the second anchor pile. The skirt extends circumferentially around the exterior surface of the first anchor pile. The second anchor pile is positioned upon the first anchor pile such that the interior passageways of the pipes associated therewith are in fluid communication. This step of inserting includes rotating an auger so as to draw the first anchor pile into the subsea soil for a desired depth.

DETAILED DESCRIPTION OF THE INVENTION

Figure 1:
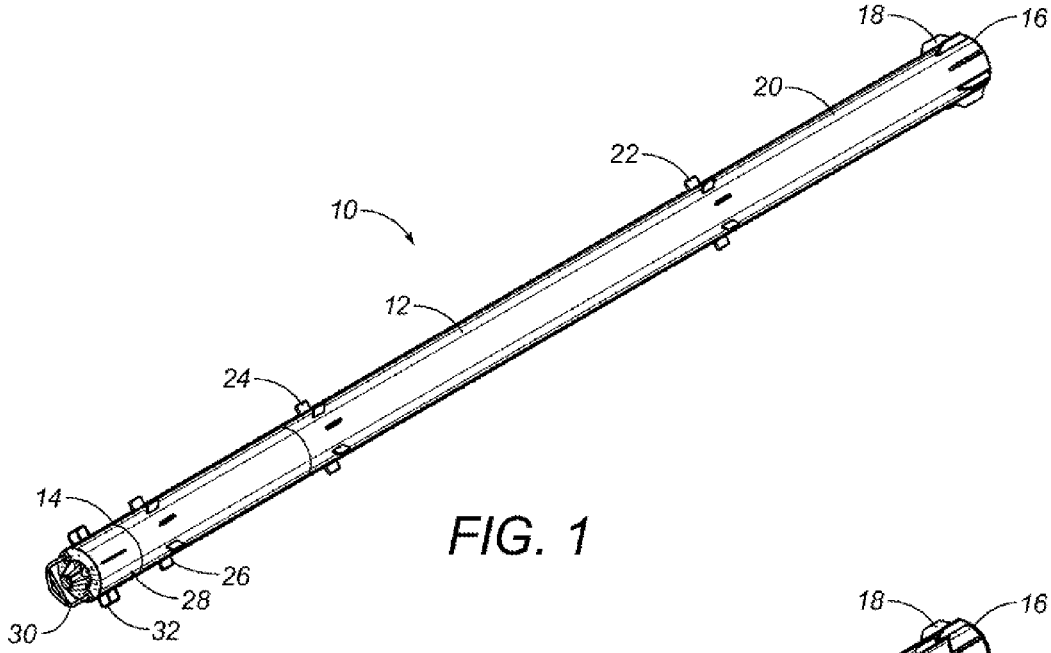
FIG. 1 is a perspective view of the anchor pile apparatus in accordance with the preferred embodiment of the present invention.

Referring to FIG. 1, there is shown the anchor pile apparatus 10 in accordance with the preferred embodiment of the present invention. The anchor pile apparatus 10 has a tubular member with an interior passageway having an upper end 14 and a lower end 16. The tubular member 12 has a first set of fins 18 extending radially outwardly of an exterior surface 20 of tubular member 12 adjacent the lower end 16. A second set of fins 22 extends radially outwardly of the exterior surface 20 of the tubular member 12 in spaced relation to the first set of fins 18. A third set of fins 24 extends radially outwardly of the end portion of tubular member 12 in spaced relationship to the second set of fins 22. A fourth set of fins 26 extends radially outwardly of the end portion of the tubular member 12 generally adjacent to the upper end 14 of the tubular member 12. A support structure 28 is affixed to the upper end 14 of the tubular member 12. The support structure 28 includes a TLP/vessel locking connection 38 at an upper end thereof. This locking mechanism 30 allows the mechanisms within the interior passageway of the tubular member 12 to be connected to a torquing tool. This torquing tool can be suitably carried, in a conventional manner, by a remotely-operated vehicle (ROV). Handles 32 extend outwardly of the support structure 28. These handles 32 allow the ROV to suitably manipulate the anchor pile apparatus 10 for positioning in a subsea soil.

Figure 2:
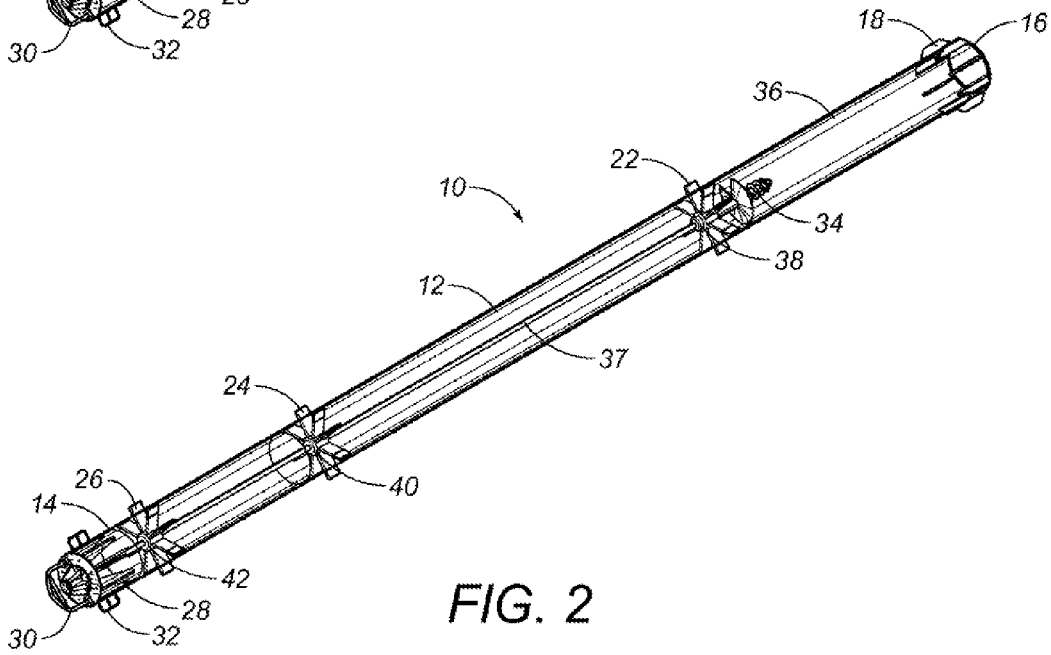
FIG. 2 is a transparent perspective view of the anchor pile apparatus of the present invention.

FIG. 2 is a transparent view of the anchor pile apparatus 10 of the present invention. In FIG. 2, it can be seen that there is an auger 34 positioned within the interior passageway 36 of the tubular member 12. The auger 34 has a spiral-type vane which can be rotated so as to install the anchor pile apparatus 10. The auger 34 is located in a position between the lower end 16 and the upper end 14 of the tubular member 12. A shaft 37 extends through the interior passageway 36 of tubular member 12 and is connected to a torque tool interface located in the support structure 28. It should be noted that, within the concept of the present invention, the auger 34 can be positioned outwardly of the lower end 16 of the tubular member 12.

In FIG. 2, it can be seen that the shaft 37 is supported adjacent to the auger 34 by a thrust bearing 38. As such, the thrust bearing 38 will allow for a rotation of the shaft 37 (along with the auger 34) while preventing axial movement of the auger 34 and the shaft 37 within the interior passageway 36. The second set of vanes 22 will extend radially outwardly from the thrust bearing 38. Another thrust bearing 40 is positioned in spaced relationship to the thrust bearing 38. The thrust bearing 40 is also connected to the third set of fins 24. Additionally, another thrust bearing 42 is supported adjacent to the upper end 40 of the tubular member 12. The thrust bearing 42 is generally positioned adjacent to the fourth set of fins 26.

Generally, in reference to FIG. 2, when a torque tool is connected to the torque tool interface in the support structure 28, the torque tool can apply a rotational motion to the shaft 37. This will cause a rotation of the auger 34. In normal use, the anchor pile apparatus 10 is first transported offshore on a barge. The anchor pile apparatus 10 is picked up and overboarded into the water. It is then up-ended so that the lower end 16 will face the subsea soil. The anchor pile apparatus 10 can be attached to an abandonment and recovery winch so as to be lowered to the targeted location on the subsea soil. The anchor pile apparatus 10 will self-penetrate into the seabed to a predetermined depth. Prior to reaching the full self-penetrating length, the auger 34 will contact the seabed. The hydraulic torque tool is installed on the torque tool interface of the support structure 28 so as to rotate the auger 34 clockwise. As the auger 34 cuts through the subsea soil, it will serve to draw the tubular member 12 in a downward directions. The fins 18 at the lower end 16 of the tubular member 12 prevent rotation and counteract torque rotation of the hydraulic torque tool. The hydraulic torque is transmitted to the auger 34 from the torque tool by way of the shaft 37. As will be described hereinafter, the shaft 37 is a drill pipe. Clamps between the drill pipe joints will allow for a counter-clockwise rotation. Within the concept of the present invention, the auger 34 can initially contact the subsea soil and rotate so as to draw the tubular member 12 downwardly toward the seabed.

Figure 3:
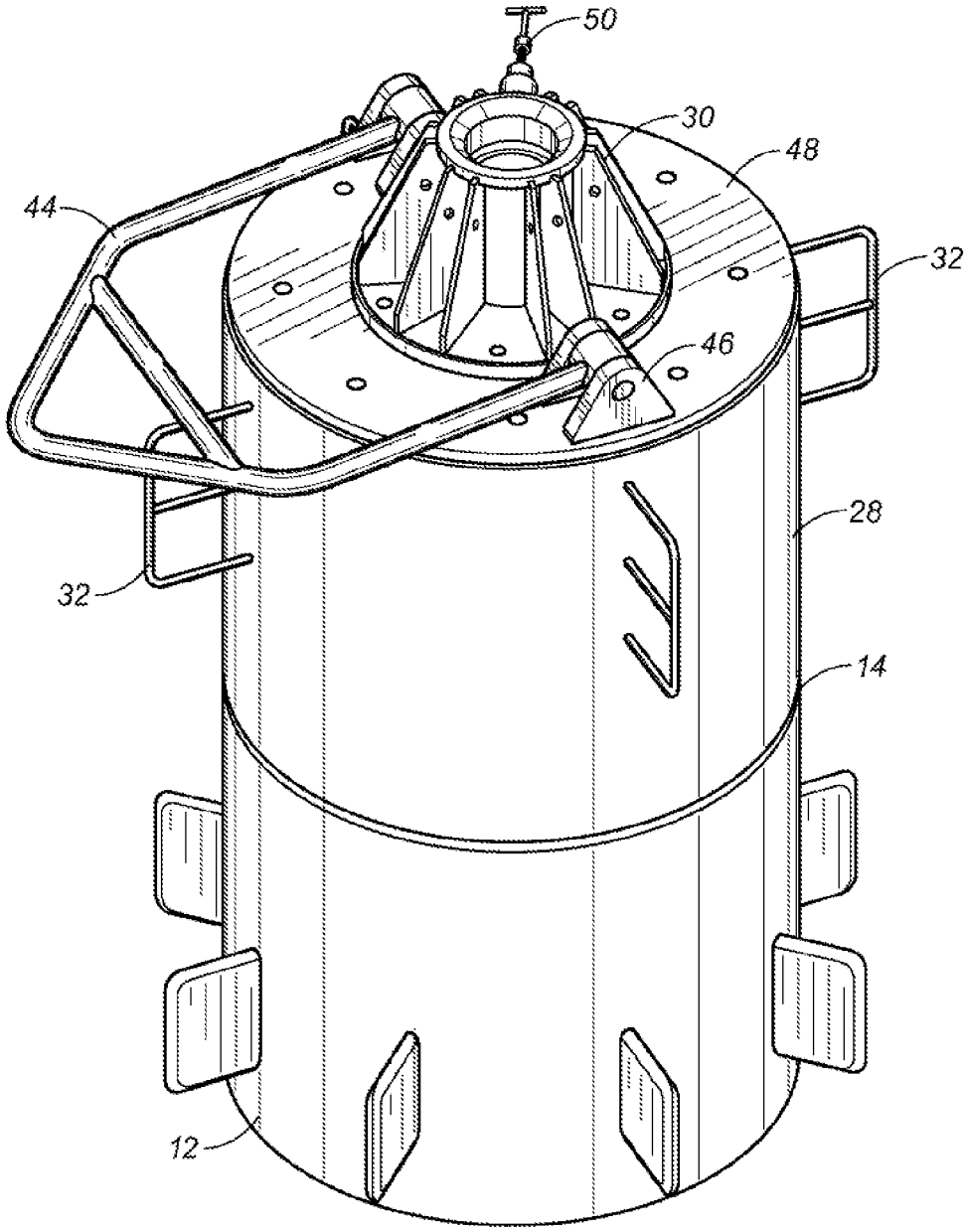
FIG. 3 is an upper perspective view showing the support structure as attached to the upper end of the tubular member of the anchor pile apparatus of the present invention.

FIG. 3 is a detailed illustration of the support structure 28 as positioned at the upper end 14 of the tubular member 12. As can be seen in FIG. 3, the support structure 28 is of a generally cylindrical shape. A bale 44 is hingedly connected to a clevis 46 positioned on the top 48 of the support structure 28. As such, the bale 44 can be suitably connected to the line of the abandonment and recovery winch so as to allow the anchor pile apparatus 10 to be lowered to the subsea soil.

Handles 32 extend radially outwardly on opposite sides of the support structure 28. Handles 32 allow the ROV to suitably manipulate the anchor pile apparatus 10. A hot stab lubricating connection 50 extends outwardly of the support structure 28. This allows the ROV to provide lubricant for the operation of the anchor pile apparatus 10. The torque tool interface 30 extends upwardly from the upper surface 48 of the support structure 28. As such, the torque tool can be suitably inserted into the interior of the torque tool interface so as to allow for the rotational movement of the shaft 37 and the auger 34.

Figure 4:
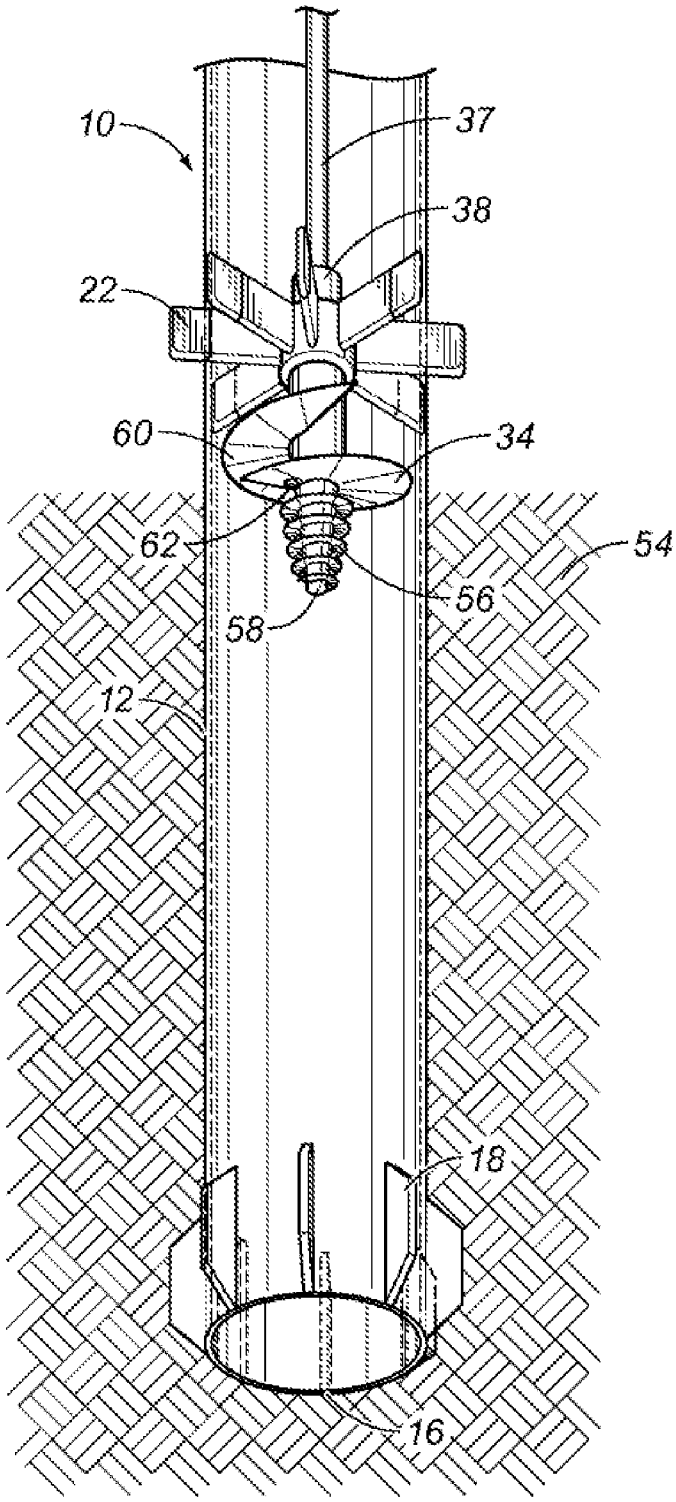
FIG. 4 is a diagrammatic illustration of the operation of the anchor pile apparatus of the present invention.

In FIG. 4, the operation of the anchor pile apparatus 10 is particularly illustrated in conjunction with the subsea soil 54. As can be seen, the lower end 16 of the tubular member 12 is lowered to a predetermined depth within the subsea soil. The tubular member 12 is lowered into the subsea soil to a depth such that the auger 34 will contact the subsea soil 54.

In FIG. 4, it can be seen that the auger 34 has a generally spiral vane 56 formed on a pointed end 58. Wider vanes 60 extend in a spiral pattern radially outwardly of the auger 34. A lubricating nozzle 62 is formed on the leading edge of the wider vanes 60. The lubricating nozzle 62 allows a lubricant fluid, such as seawater, to be ejected under pressure in a direction toward the lower end 16 of the tubular member 12.

The thrust bearing 38 is illustrated as located at a position adjacent to the second set of vanes 22. The shaft 37 extends through the thrust bearing 38 so as to connect with the auger 34. The first set of fins 18 are engaged with the subsea soil 54 so as to generally fix a rotational position of the tubular member 12 within the subsea soil 54 and to counteract any torque applied to the auger 34. The shaft 37 is in the nature of a drill pipe having an interior passage. As such, this interior passageway will allow high-pressure seawater ejection through the nozzle 28 to the leading cutting edge of the auger 34. As such, this ejected seawater will act as a lubricant. The high-bearing load on the top of the auger 34, as it penetrates into deeper more compact soils, allows the auger to penetrate deep into the soil. The thrust bearing 38 over the shaft 37 transfers load to the skin of the tubular member 12. This prevents the shaft 37 from being subjected to buckling loads. Once the pile has reached a desired depth, the rotation of the auger 34 can cease. As the soil around the tubular member 12 has consolidated, the majority of the strength of the anchor pile apparatus 10 will come from the friction of the soil against the tubular member 12. Moreover, the mud core weight within the interior passageway 36 of the tubular member 12 will provide additional strength, both in tension and compression.

If it is desired to retrieve the anchor pile apparatus 10, the shaft 37 will be rotated in a counter-clockwise direction. During the first quarter turn, the lubricating nozzle 62 is shut off and the retrievable lubricant nozzle will open. This can be accomplished through a plug valve arrangement within the auger 34. The retrievable lubricant nozzle will lubricate the bottom of the auger where it will be exposed to higher soil loads. The auger 34 is reversed until it clears the subsea soil 54. As such, the winch is able to pull the remainder of the anchor pile apparatus 10 out of the subsea soil 54.

Figure 5:
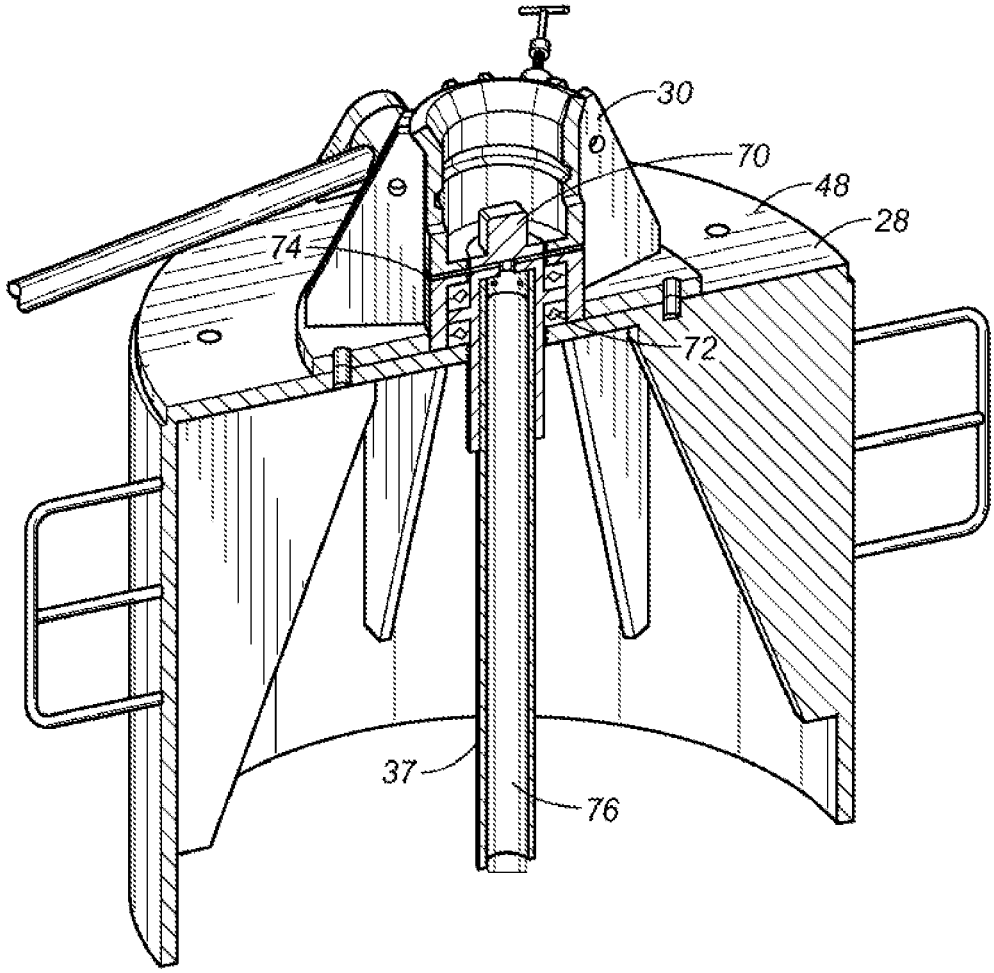
FIG. 5 is a cross-sectional view showing the support structure at the upper end of the anchor pile apparatus of the present invention.

FIG. 5 shows an interior view of the support structure 28. In FIG. 5, the torquing tool interface 30 extends upwardly from the upper surface 48 of the support structure 28. An end effector 70 is connected to the upper end of the shaft 37. Suitable bearings 72 will extend around the end effector 70 so as to allow for rotational movement of the shaft 37. A port 74 is provided so as to allow for the introduction of the seawater or other lubricant into the interior passage 76 of the shaft 37. As such, the present invention allows for the high pressure seawater to be utilized, in conjunction with the anchor pile apparatus 10, so as to provide the ejection force of the seawater through the nozzle 62.

It can be seen that the present invention provides an anchor pile apparatus 10 which includes suitable mechanisms within the interior thereof that allow the anchor pile apparatus 10 to be effectively driven into the subsea soil. The anchor pile apparatus 10 of the present invention can be installed through the use of the ROV in deep and ultra-deep water. There is only a need for the transport barge and the abandonment and recovery winch to be located on the surface of the sea. The present invention eliminates the need for complex structures and mechanisms on the surface of the water. The use of the auger 34 allows the anchor pile apparatus 10 to be driven to greater depths. This allows smaller and stronger piles to be applied in ultra-deep water.

Figure 6:
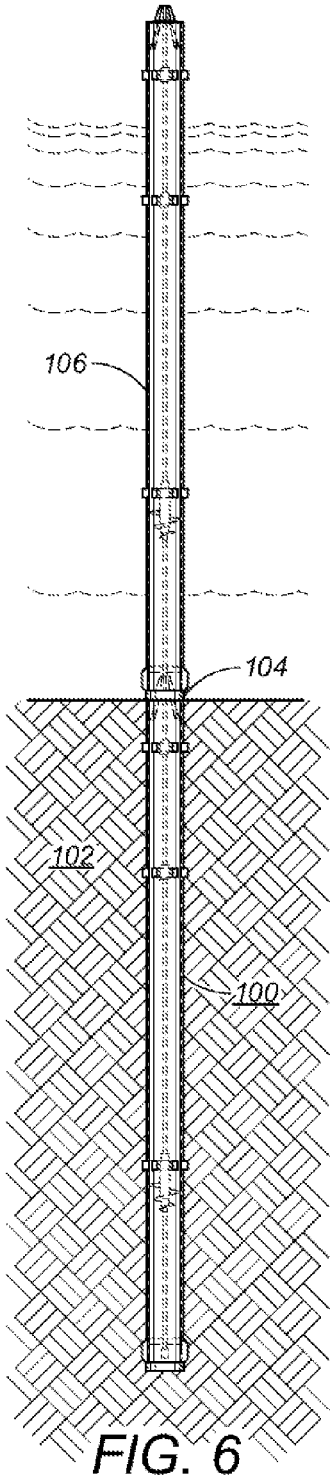
FIG. 6 is a side elevational view showing a first anchor pile joined to a second anchor pile in a subsea location.

It is an important feature of the present invention that the installed anchor pile have a desired length. In the anchor pile described in the previous FIGS. 1-5, the structure of the anchor pile will have a generally fixed length. In other words, the tubular member will have a non-adjustable length. The support structure is affixed to an end of the tubular member. The auger and the shaft extend through the interior of the tubular member. However, in certain circumstances, the subsea operations may require the anchor pile to have a longer length. In particular, under certain circumstances, it may be desirable to have the anchor pile extending outwardly and above the subsea soil for a desired distance. As such, various external appliances and connections can be made with the anchor pile in a location above the subsea soil. FIG. 6 illustrates a manner in which a first anchor pile can be connected to a second anchor pile.

Specifically, in FIG. 6, it can be seen that the first anchor pile 100 has been driven into the subsea soil 102 to a desired depth. An upper end 104 of the first anchor pile 100 will extend above the top surface of the subseal soil 102. FIG. 6 shows that a second anchor pile 106 has its lower end affixed within the upper end 104 of the first anchor pile 100. As such, the second anchor pile 106 will extend a desired length above the top of the subsea soil 102. Within the concept of the present invention, several anchor piles can be connected in end-to-end relationship such that the anchor pile assembly will extend a desired length above the subsea soil.

Figure 7:
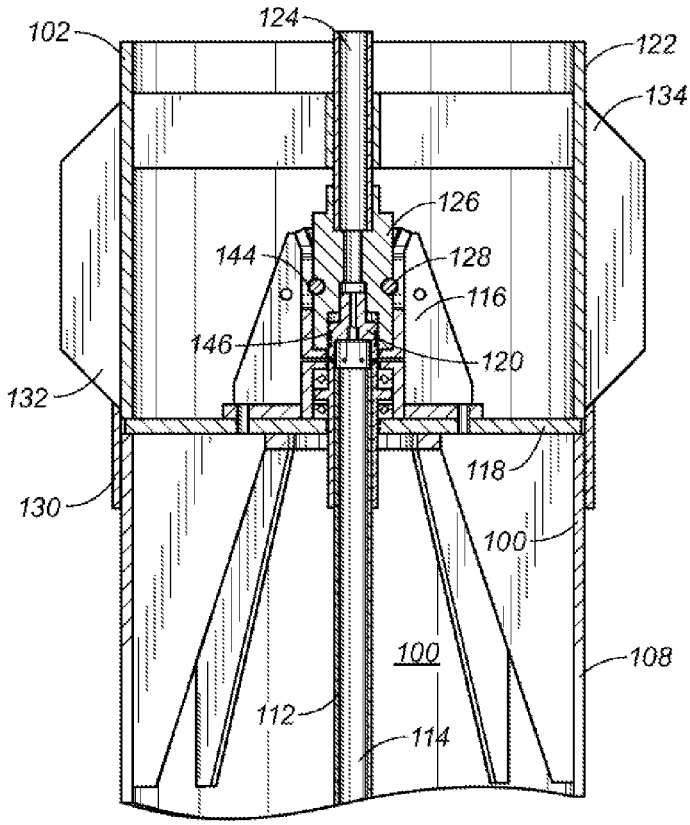
FIG. 7 is cross-sectional view showing the connection between the upper end of the first anchor pile with the lower end of the second anchor pile.

FIG. 7 shows a detailed view of how the first anchor pile 100 is connected the second anchor pile 102. In particular, it can be seen that the first anchor pile 100 has a structure similar to that shown in previous FIGS. 1-5. In particular, the first anchor pile 100 includes a tubular member 108 having an interior passageway 110. The shaft 112 will extend downwardly through the interior passageway 110. Shaft 112 is in the nature of a pipe having an interior passageway 114 extending therethrough. A support structure 116 is affixed to the upper end of the tubular member 108. Specifically, the support structure 116 has an upper surface 118 that extends over the end of the tubular member 108. It can be seen that the shaft 112 has an end connector 120 formed at an upper thereof. The second anchor pile 102 also is formed of a tubular member 122 and has a shaft 124 extending therethrough. Shaft 124 can also be in the nature of a pipe having an interior passageway. The shaft 124 has a pin member 126 formed at an end thereof. In FIG. 7, it can be seen that the pin member 126 is received within the generally tubular passageway of the support structure 116. A latch 128 serves to fixedly secure the pin member 126 against a wall of the generally tubular passageway of the support structure 116. In this manner, the shaft 124 is joined in end-to-end connection with the shaft 112. As will be described hereinafter, the interior passageways of the first shaft 112 and the second shaft 124 will be in fluid communication.

The tubular member 122 of the second anchor pile 102 has a skirt 130 extending downwardly from a lower thereof. The skirt 130 will overlie the exterior surface at the upper end of the tubular member 108 of the first anchor pile 100. The skirt 130 assures that the first anchor pile 100 is in properly aligned end-to-end relationship with the second anchor pile 102. Fins 132 and 134 extend radially outwardly from the exterior surface of the tubular member 122.

Figure 8:
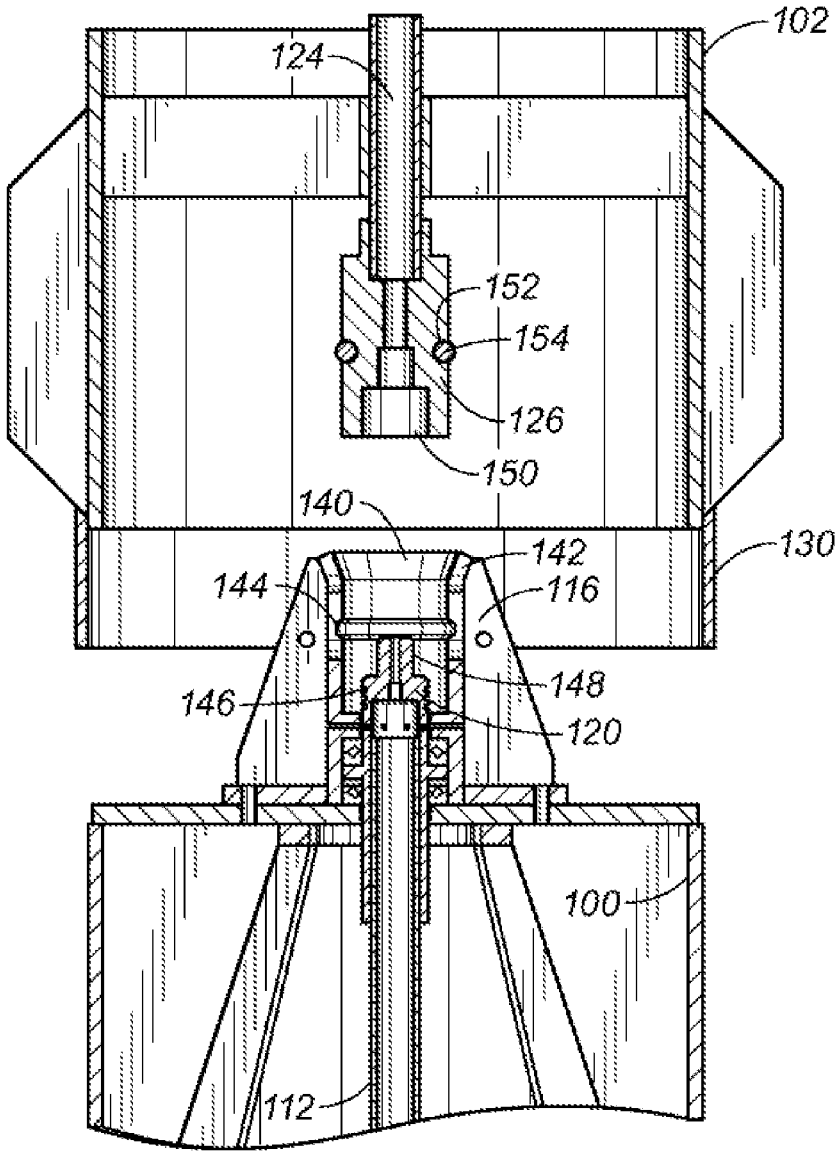
FIG. 8 is a cross-sectional view showing the installation of the second anchor pile upon the support structure of the first anchor pile.

FIG. 8 illustrates the manner in which the first anchor pile 100 is to be connected to the second anchor pile 102. In particular, it can be seen that there is a generally tubular passageway 140 formed within the interior of the support structure 116. A funnel 142 is formed at the upper end of the generally tubular passageway 140. Funnel 142 flares outwardly at the upper end thereof. Funnel 142 will serve to urge the pin member 126 toward the generally tubular passageway 140 of the support structure 116 such that the first shaft 112 is properly joined in end-to-end relationship with the second shaft 124. It can be seen that there is a groove 144 that is formed in the wall of the generally tubular passageway 140 of the support structure 116.

The end connector 120 of the shaft 112 includes a first cylindrical portion 146 and a generally cylindrical portion 148. The first cylindrical portion 146 has a larger diameter than the second cylindrical portion 148. A fluid passageway is illustrated as extending through the first cylindrical portion 146 and the second cylindrical portion 148.

The pin member 126 has a receptacle 150 opening at a lower end thereof. The receptacle 150 will extend over and around the first cylindrical portion 146 and the second cylindrical portion 148 of the end connector 120 of shaft 112. As illustrated in FIG. 7, it can be seen that the first cylindrical portion 146 has a plurality of O-ring seals that extend circumferentially therearound so as to establish a liquid-tight sealing relationship with the wall of the receptacle 150.

The pin member 126 includes a notch 152 extending circumferentially therearound. An annular member 154 is received within this notch 152 of the pin 126. With reference to FIG. 7, it can be seen that the annular member 154 is the "latch" of the present invention and is received within the groove 144 of the support structure 116. This establishes a tight and secure engagement between the shafts 112 and 124.

In normal use, in order to join the first anchor pile 100 to the second anchor pile 102, it is only necessary to align the second anchor pile 102 with the first anchor pile 100 such that the skirt 130 will slide over the exterior of the first anchor pile 100. Also, the pin member 126 will move gradually downwardly through the funnel 142 of the tubular passageway 140. A downward force will cause the latch 128 with the support structure 116 so as to establish a tight fit therein. The interior of the second shaft 124 will then be in fluid communication with the interior passageway 114 of the first shaft 112.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An anchor pile apparatus comprising:

a first tubular member having an interior passageway at an upper end and a lower end;

a support structure affixed to an upper end of said tubular member, said support structure defining a generally tubular passageway;

a first shaft rotatably mounted in said support structure, said first shaft extending through said interior passageway of said first tubular member, said first shaft having an end connector formed at an upper end thereof;

an auger affixed to a lower end of said first shaft, said first shaft being rotatable independently of said first tubular member, said auger positioned inwardly of said lower end of said first tubular member, said auger positioned at a fixed longitudinal position along a longitudinal axis of said first tubular member;

a second shaft having a pin member at a lower end thereof, said pin member received in said generally tubular passageway so that said first shaft is connected in end-to-end relation with said second shaft so as to transmit a rotation of said second shaft to said first shaft; and a second tubular member having an interior passageway through which said second shaft extends, said second tubular member having a lower end abutting an upper end of said first tubular member.

2. The anchor pile apparatus of claim 1, further comprising:

a latching means affixed to said pin member of said second shaft, said latching means for engaging a wall of said generally tubular passageway of said support structure.

3. The anchor pile apparatus of claim 2, said pin member having a notch extending circumferentially therearound, said wall of said generally tubular passageway having a groove formed therein, said latching means comprising:

an annular member received in said notch and in said groove.

4. The anchor pile apparatus of claim 1, said end connector having a first cylindrical portion and a second cylindrical portion extending upwardly from said first cylindrical portion, said pin member having a receptacle receiving said first and second cylindrical portions therein.

5. The anchor pile apparatus of claim 4, said first shaft being a first pipe having an interior passageway, said second shaft being a second pipe having an interior passageway in fluid communication with said interior passageway of said first pipe.

6. The anchor pile apparatus of claim 4, said second tubular member having a skirt extending downwardly from said lower end of said second tubular member, said skirt extending around an exterior surface of said upper end of said first tubular member.

7. The anchor pile apparatus of claim 4, said support structure having a funnel formed at an upper end thereof, said funnel opening to said generally tubular passageway of said support structure.

8. The anchor pile apparatus of claim 4, said second tubular member having a plurality of fins extending radially outwardly therefrom.

9. A method of forming an anchor pile assembly for insertion into a subsea soil, the method comprising:

lowering a first anchor pile to the subsea soil such that a lower end of said first anchor pile penetrates into the subsea soil, said first anchor pile having a first pipe extending along a longitudinal axis of said first anchor pile, said first anchor pile having an auger affixed to a lower end of said first pipe such that said auger resides at a fixed longitudinal position relative to the longitudinal axis of said first anchor pile inwardly of said lower end of said first anchor pile;

rotating said first pipe and said auger so as to draw said first anchor pile deeper into said subsea soil, said first anchor pile having an upper end extending outwardly of the subsea soil, said upper end thereof, said support structure having a generally tubular passageway;

lowering the second anchor pile toward the first anchor pile such that an a lower end of the second anchor pile faces said support structure of the first anchor pile;

inserting a pin member of the second anchor pile into the generally tubular passageway of said support structure; and latching the pin member against the wall of said generally tubular passageway of said support structure.

10. The method of claim 9, the second anchor pile having a skirt extending downwardly from said lower end thereof, the method further comprising:

inserting said upper end of said first anchor pile into said skirt such that said skirt extends circumferentially around an exterior surface of the first anchor pile.

11. The method of claim 9, said first pipe having an interior passageway, said second anchor pile having a second pipe extending therethrough, said second pipe having an interior passageway, the method further comprising:

positioning the second anchor pile upon the first anchor pile such that the interior passageways of said first and second pipes are in fluid communication.

* * * * *